US005099214A

United States Patent [19]

Rosen et al.

[11] Patent Number: 5,099,214

[45] Date of Patent: Mar. 24, 1992

[54] OPTICALLY ACTIVATED WAVEGUIDE TYPE PHASE SHIFTER AND ATTENUATOR

[75] Inventors: Arye Rosen, Cherry Hill, N.J.; Paul J. Stabile, Langhorne, Pa.; Walter M. Janton, Bellmawr, N.J.

[73] Assignee: General Electric Company, Camden, N.J.

[21] Appl. No.: 413,156

[22] Filed: Sep. 27, 1989

[51] Int. Cl.[5] ..... H01P 1/15; H01P 1/18; H01P 1/22

[52] U.S. Cl. ..... 333/157; 333/81 B; 333/258; 333/262; 333/99 PL

[58] Field of Search ..... 333/81 B, 157, 258, 333/262, 99 PL

[56] References Cited

U.S. PATENT DOCUMENTS

| | | | |
|---|---|---|---|
| 2,856,589 | 10/1958 | Kazan | 333/81 B |
| 2,978,652 | 4/1961 | Thomas | 333/81 B X |
| 3,721,923 | 3/1973 | Gray et al. | 333/157 |
| 3,408,601 | 10/1968 | Moskowitz | 333/258 |
| 4,263,570 | 4/1981 | De Fonzo et al. | 333/157 |
| 4,675,624 | 6/1987 | Rosen et al. | 333/164 X |
| 4,835,500 | 5/1989 | Sequeira | 333/258 |

FOREIGN PATENT DOCUMENTS

| | | | |
|---|---|---|---|
| 2251924 | 6/1975 | France | 333/258 |

OTHER PUBLICATIONS

"Millimeter-Wave Phase Shifter", *RCA Review*, vol. 34, Sept. 1973, pp. 489-505, by B. J. Levin et al.

"Fast-Rise Microwave Switching Through Reflection and Transmission Induced by Photoconductivity", *U.S. Army Technical Report No. HDL-TR-0272*, Jan. 1986, pp. 1-28, by George A. Huttlin et al.

"Optical Control of Millimeter-Wave Propagation in Dielectric Waveguides", *IEEE Journal of Quantum Electronics*, vol. QE-16, No. 3, Mar. 1980, pp. 277-287, by Chi H. Lee et al.

"Laser Activated PIN Diode Switch from DC to mm--Wave", Session 13: New Applications for Electro-Optical Components, *Electro/89 Electronic Show and Convention*, Jacob K. Javits Convention Center, New York, N.Y., Apr. 11-13, 1989, Session 13/4, pp. 1-6, by Arye Rosen et al.

Leonberger, F. J. and Moulton, P. F.; "High Speed InP Optoelectronic Switch", *Applied Physics Letters;* No. 35(9); Nov. 1, 1979; pp. 712-714.

*Primary Examiner*—Eugene R. LaRoche
*Assistant Examiner*—Benny T. Lee
*Attorney, Agent, or Firm*—Geoffrey H. Krauss; Stephen A. Young; Allen E. Amgott

[57] ABSTRACT

A waveguide having walls defining an opening. An optically transmissive aperture in one wall allows light from an optical illumination source such as a laser diode array to illuminate the opening in which is located a semiconductor slab positioned to be illuminated. When the array illuminates the slab, the propagation characteristics (phase velocity and attenuation constant) of the waveguide changes. A continuous wave signal passing through the waveguide is thus attenuated and phase shifted. The laser array may be pulsed on and off while still maintaining the altered propagation constant.

14 Claims, 3 Drawing Sheets

30

OPTICALLY ACTIVATED WAVEGUIDE TYPE PHASE SHIFTER AND ATTENUATOR

BACKGROUND OF INVENTION

1. Field of Invention

This invention relates to waveguide attenuators and phase shifters and, more particularly, to such attenuators and phase shifters which are optically activated.

2. Description of the Prior Art

There are applications which utilize waveguides to pass microwave and millimeter wave signals where it is desired to phase shift or attenuate or, in the extreme, switch off the microwave or millimeter wave signal. It is known to utilize, as a switch, a waveguide with a light responsive semiconductor in the waveguide cavity being orthogonal to the direction of signal propagation. When light from a light source traveling in the waveguide parallel to the direction of signal propagation in the waveguide strikes the semiconductor, it changes from a dielectric to a conductor blocking the signal which would otherwise pass through the waveguide. A problem with such a switch is the complexity of the structure due to the light location and the cost of construction.

It is also known that dielectric mode devices could function as attenuators and phase shifters as disclosed in "Optical Control of Millimeter-Wave Propagation in Dielectric Waveguides" *IEEE Journal of Ouantum Electronics*, Vol. QE-16, No. 3, March 1980, pp. 277–287, by Chi H. Lee, P. S. Mak and A. P. DeFonzo. A dielectric mode device consists of a rectangular semiconductor waveguide with tapered ends to allow efficient transition to and from a conventional metallic waveguide. Optical control is realized when the broad wall of the semiconductor guide is illuminated by laser light creating plasma. The effect of the plasma occupied region is to introduce a layer whose index of refraction at millimeter waves is different from the remaining volume of the bulk semiconductor, thus providing phase shifting and attenuation effect. In the prior art, however, the isolation between phase shifting and attenuation is difficult. In addition, the arrangement calls for a high power continuous wave laser, making the device bulky and expensive.

The design and fabrication of electronically controlled phase shifters and attenuators at millimeter wave is also know using bulk semiconductors in guided wave structures as disclosed in "Millimeter-Wave Phase Shifter," *RCA Review*, Vol. 34, Sept. 1973, pp. 489–505, by B. J. Levin and G. G. Weidner. Phase shift/attenuation is produced by the electronic modulation of the width of a rectangular waveguide. The change in effective width of the waveguide is accomplished by means of a PIN diode that is literally distributed along the small side wall of the waveguide. In the embodiment, the interaction (lack of isolation) between the power supply driving the PIN device and the propagating millimeter wave appears to limit the useful bandwidth of this device.

SUMMARY OF THE INVENTION

In accordance with a preferred embodiment of the preferred invention a waveguide attenuator or phase shifter comprises a waveguide having opposed first and second walls and opposed third and fourth walls each adjacent the first and second walls, the four walls defining an opening in the waveguide, one of the walls including an optically transmissive aperture, an optical illumination source positioned relative to the aperture to be capable of illuminating a portion of the opening and a semiconductor slab positioned in the opening such as to be capable of being illuminated by the source. The slab when illuminated by the source, induces plasma. The induced plasma alters the propagation characteristics associated with the waveguide.

DETAILED DESCRIPTION

Figure 1:
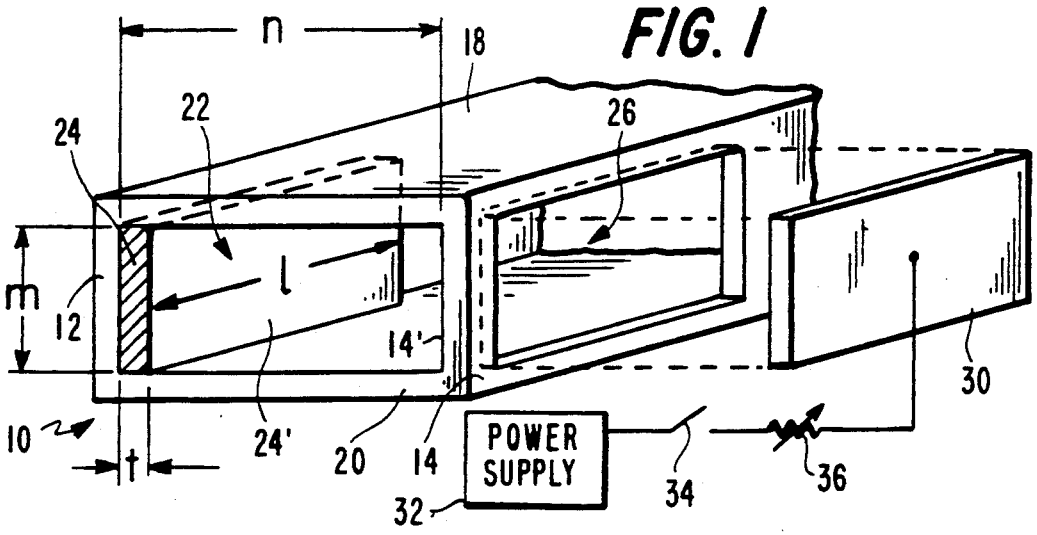
FIG. 1 is a waveguide structure in accordance with one embodiment of the present invention.

In FIG. 1, to which attention is now directed, a waveguide 10, useful in microwave/millimeter wave applications, comprises opposed first and second relatively narrow elongated metal walls 12 and 14 each adjacent and normal to opposed third and fourth relatively wide elongated walls 18 and 20. The walls define an opening 22 of dimension m parallel to walls 12, 14 by dimension n parallel to walls 18, 20 where $n>m$. In one exemplary embodiment for use in the 50–75 GHz frequency range, $m=0.074$ inch and $n=0.148$ inch. Waveguide 10 is illustrated broken away and, although not illustrated, would typically have, at each end thereof, a flange to allow mounting to other waveguide structures, as is known to those skilled in the art. Thus far in the description, the waveguide is of a completely standard construction.

As illustrated in FIG. 1, a semiconductor slab 24 is attached to wall 12 in opening 22 of waveguide 10. Slab 24 is of width m, thickness t, and length l where exemplary dimensions are $t=0.004$ inch, $l=0.400$ inch, and $m=0.074$ inch. Exemplary materials for slab 24 are silicon (Si) or gallium arsenide (GaAs). On a portion of the wall 14 is located an optically transmissive aperture 26 which is typically opposite slab 24 and of the same dimension, i.e. m by l, or such size that all of slab 24 can be illuminated. Associated with the aperture is an optical illumination source 30 such as a laser diode array which is positioned to illuminate slab 24 and typically is mounted in aperture 26 such that it does not project beyond surface 14' of wall 14 into opening 22. Alternatively, source 30 may be located outside aperture 26 in which case aperture 26 may be filled with a suitable material which still allows illumination of slab 24 by source 30.

Figure 3:
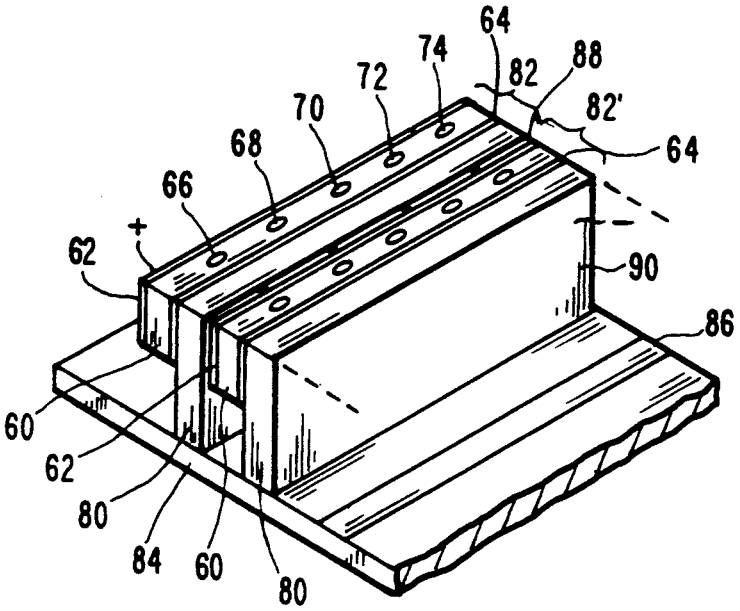
FIG. 3 is a laser light source array useful in practicing the invention of FIG. 1 or FIG. 2.

A suitable laser diode array source 30 is illustrated in FIG. 3 to which attention is now directed. FIG. 3 illustrates a two dimensional laser diode array source 30 suitable for supplying photon energy to semiconductor slab 24 of FIG. 1 to induce plasma therein. In FIG. 3, laser diode array source 30 includes a plurality of one dimensional laser array assemblages (two, 82 and 82' being shown). Array assemblage 82, for example, includes a layered semiconductor substrate 60, the individual layers of which are not illustrated. Semiconductor substrate 60 lies between metallized layers 62 and 64 which are adapted to receive direct voltage in order to produce photon energy in the form of light radiation from a plurality of discrete radiation sites, 66, 68, 70, 72 and 74 being exemplary. The positive potential (+) of the direct voltage is applied to layer 62 while the negative potential is supplied via assemblage 82'. Each laser array assemblage 82, 82' also includes a rectangular block 80 of thermally conductive material such as surface-metallized beryllium oxide (BeO) to which is bonded, for example by soldering, conductor 64. Rectangular block 80 thus acts as a heat sink and will be referred to hereinafter as heat sink 80. Thus, FIG. 3 illustrates a two-dimensional radiating array of laser diodes.

Heat sinks 80 are mounted to a thermally conductive BeO mounting substrate 84 which has deposited thereon a series of spaced metallization stripes, one of which is illustrated as 86. Metallization stripes 86 provide a surface to which heat sinks 80 of assemblage 82 may be attached as by soldering. When so arranged, the laser diode array of assemblage 82', for example, has a heat sink 80 on each side, each of which conducts heat from the laser diode array to mounting substrate 84, which either rejects the heat directly or conducts it to a further heat sink, not illustrated.

In FIG. 3 assemblages 82 and 82' are spaced apart slightly to form a gap 88, and electrical contact is made by means of gold bumps, not separately designated. Such gold bumps provide a certain amount of cushioning to aid in preventing stress due to thermal effects, and also to provide some thermal contact. Alternatively, the adjacent surfaces of assemblages 82 and 82' may be soldered together directly, without gold bumps. In either manner of assembly, the arrays of laser diodes are energized in a series combination with electrical connections made to apply positive voltage to conductor 62 and negative voltage to conductive surface 90 of heat sink 80 as indicated by + and − signs, respectively. Additional assemblages similar to 82 (but not illustrated) can be added to the array of FIG. 3 to provide any desired amount of light. An exemplary amount of light provided by the array 30 of FIG. 3 is 10W–100W. It is, of course, the surface of laser array 30 which contains diodes 66, 68, 70, 72, and 74 which is positioned relative to aperture 26 to illuminate slab 24.

Figure 1A:
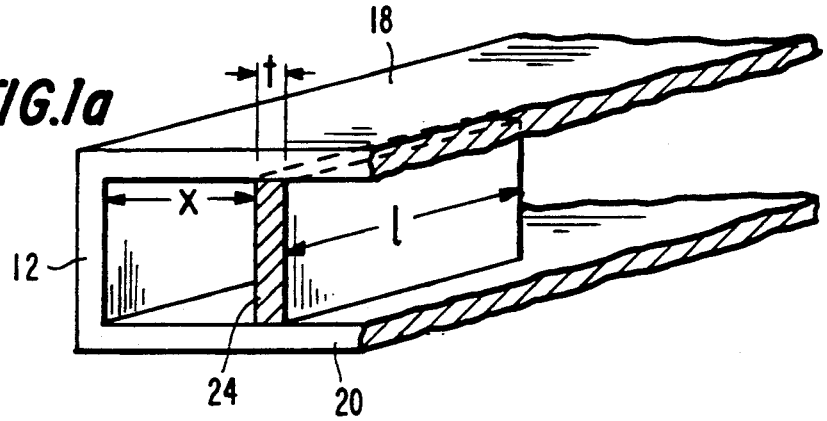
FIG. 1*a* is an alternative structure to that shown in FIG. 1.

FIG. 1*a* illustrates a waveguide identical to that in FIG. 1 except that slab 24 is spaced off wall 12 by a distance x within opening 22 positioned to be illuminated by source 30 (FIG. 1). Distance x may be such that slab 24 is centered along distance n.

Figure 2:
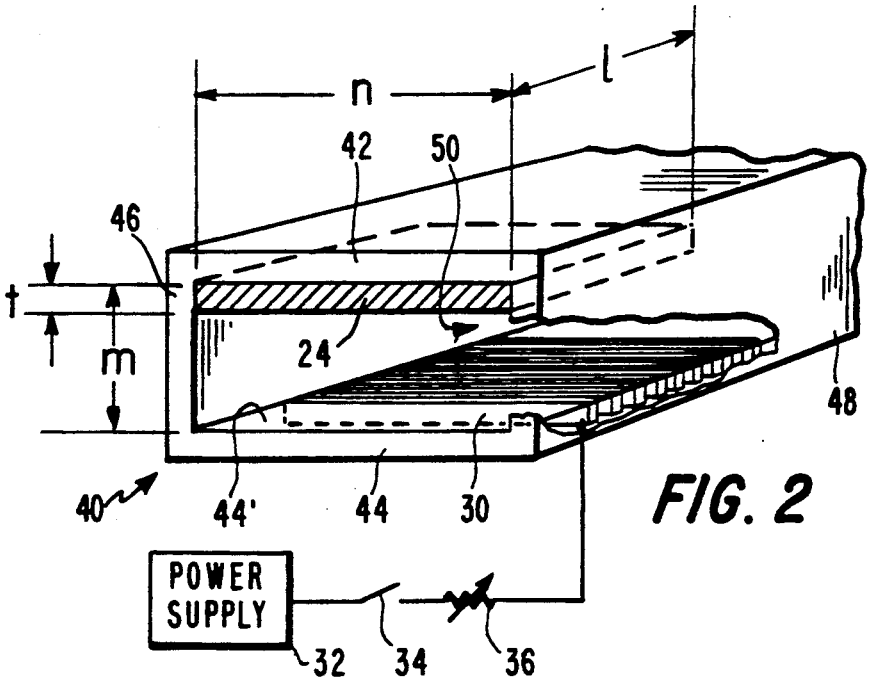
FIG. 2 is another waveguide structure in accordance with another embodiment of the present invention.

FIG. 2, to which attention is now directed, illustrates an alternative embodiment. Here a waveguide 40 comprises opposed first and second elongated sides 42 and 44 each adjacent opposed elongated walls 46 and 48, the latter being shown partially broken away. The walls define on opening 50 of dimension m parallel to walls 46, 48 by dimension n parallel to walls 42, 44 where $n>m$, and m and n are dimensioned as in FIG. 1. In FIG. 2, a semiconductor slab 24 of length l and thickness t, is affixed to the inside of wall 42 in opening 50 while a laser diode array source 30 is located in wall 44 in an aperture not separately shown but similar to aperture 26 in FIG. 1 such that the laser array does not project beyond surface 44' of wall 44 into opening 50. As with the waveguide structure of FIG. 1 the laser array may be positioned outside wall 44.

In both FIGS. 1 and 2, a direct current power supply 32 is series connected with a switch 34 and current adjusting potentiometer 36 to laser diode array source 30, connected to the + and − terminals thereof as illustrated in FIG. 3. In this way laser diode array source 30 can be both turned on and off by means of switch 34 and the current applied to source 30, and therefore its light output, which is a function of current applied thereto, can be controlled by the setting or potentiometer 36. Further, when the laser diode array source 30 is "on" it can in fact be pulsed on and off by opening and closing switch 34.

Operation of FIGS. 1 and 2 is essentially the same. The waveguide structure of FIG. 2 is simply more sensitive than that of FIG. 1 with regard to the change in characteristics as a function of light applied to the semiconductor slab 24. With no optical power illuminating the slab device, the transmission line is a rectangular waveguide of width n loaded with a semiconductor slab device of thickness t. Impinging optical, power onto slab 24 from source 30 induces plasma in the slab. The presence of the plasma alters the propagation characteristics (phase velocity and attenuation constant) of the waveguide. When the light intensity is increased sufficiently, the plasma induced in slab 24 is of sufficient density to change the effective (electrical) waveguide dimension to a new dimension n-t in FIG. 1 or a new dimension n-(t+x) in FIG. 1*a* or from dimension m to dimension m-t in FIG. 2. The result of inducing plasma is a change in the waveguide phase shift/attenuation per unit length of the slab measured along the waveguide in the direction of length l relative to the unilluminated condition. With variation in thickness t relative to width n one can achieve maximum phase shift with minimum attenuation (phase shifter) or maximum attenuation with minimum phase shift (attenuator). With sufficient illumination and/or placement of slab 24 in opening 22 in FIG. 1 (or opening 50 in FIG. 2) the continuous wave signal passage through the waveguide may be stopped (i.e. a switch). In addition, the light penetration into the slab 24, which depends on the wavelength of optical source 30 as well as on the slab material chosen, will create phase shift and attenuation modelled after Levin et al. as identified earlier herein.

Figure 4:
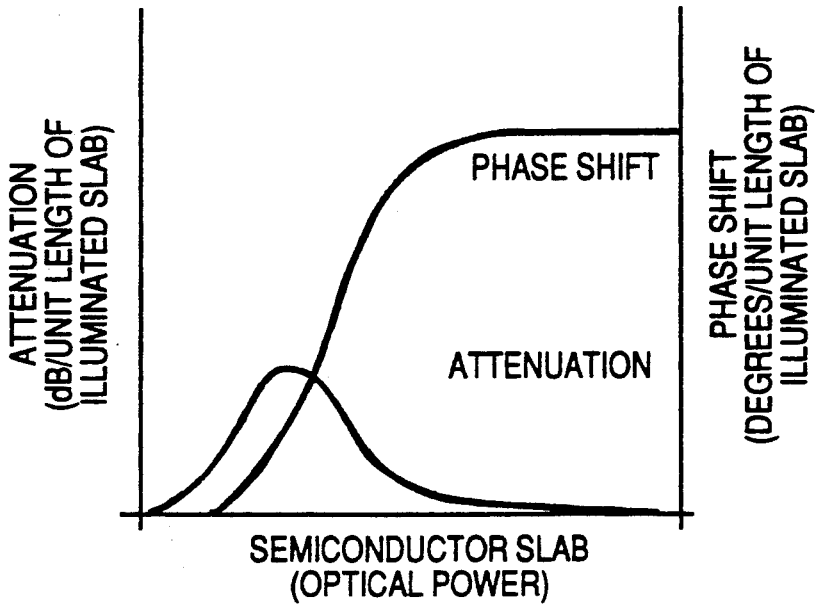
FIG. 4 is a set of waveforms illustrating a waveguide exhibiting low attenuation and high phase shift as a function of optical power.
Figure 5:
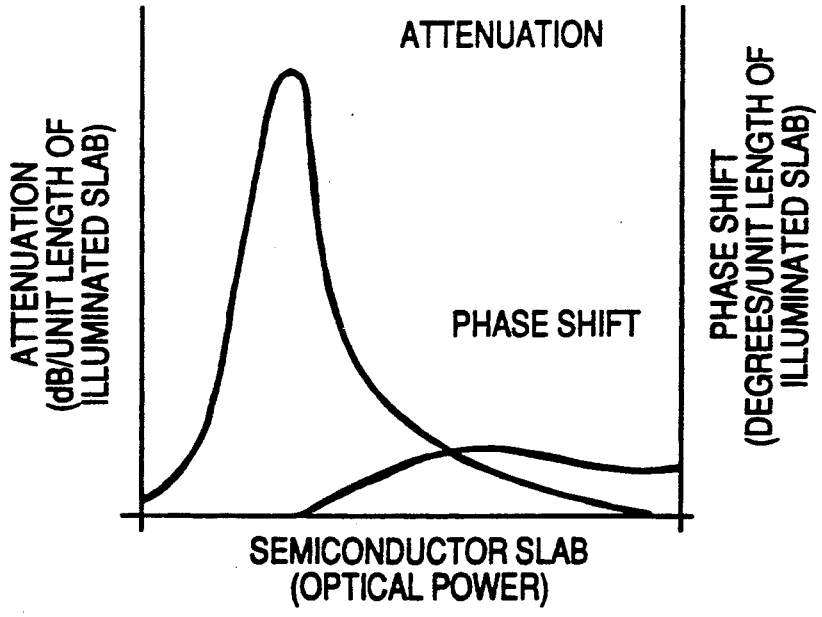
FIG. 5 is a set of waveforms illustrating a waveguide exhibiting high attenuation and low phase shift as a function of optical power.

Examination of FIG. 4 indicates that maximum phase shift is obtained for a certain slab thickness accompanying minimum attenuation. FIG. 5 depicts a different relative slab thickness introducing maximum attenuation with minimum phase shift.

In the FIG. 2 embodiment relative to the FIG. 1 embodiment, larger sizes of semiconductor slab 24 and the relatively close distance between the laser array 30 and semiconductor slab 24 makes the impedance of the waveguide sensitive to a small variation in light intensity. The sensitive changes in impedance characteristics of the waveguide with light intensity introduces a variable attenuator.

It has been found that continuous illumination is not necessary to maintain semiconductor 24 in a given state. Rather, the laser can be pulsed on and off with, for example, a 5% duty cycle without appreciably affecting the transmission characteristics of continuous wave signal passing through the waveguide relative to the transmission characteristics with the laser continuously illuminated. By pulsing the laser the rather considerable heat which it generates is much reduced and more easily dissipated.

What is claimed is:

1. In combination:

a rectangular waveguide comprising opposed first and second walls and opposed third and fourth walls each adjacent said first and second walls, said first, second, third and fourth walls defining an opening in said waveguide, any one of said first, second, third and fourth walls including an optically transmissive aperture, said waveguide having associated propagation characteristics;

an optical illumination source comprising a laser diode array positioned in said aperture for illuminating a portion of said opening; and a semiconductor slab positioned in said opening having a surface capable of being illuminated by said source, said surface characterized by predetermined dimensions;

said slab, when illuminated by said source, inducing plasma for altering said propagation characteristics associated with said waveguide.

2. The combination as set forth in claim 1 wherein said rectangular waveguide includes said third and fourth walls which are relatively closer together than are said first and second walls and wherein one of said first and second walls includes said optically transmissive aperture.

3. The combination as set forth in claim 1 wherein said laser diode array is of dimensions as measured in a plane passing along said wall containing said aperture which are substantially the same as said dimensions of said surface of said semiconductor slab.

4. The combination as set forth in claim 3 wherein said rectangular waveguide includes said third and fourth walls which are relatively closer together than are said first and second walls and wherein one of said first and second walls includes said optically transmissive aperture.

5. The combination as set forth in claim 3 wherein said rectangular waveguide includes said third and fourth walls which are relatively closer together than are said first and second walls and wherein one of said third and fourth walls includes said optically transmissive aperture.

6. The combination as set forth in claim 1 wherein said semiconductor slab is positioned in said opening at another wall of said first, second, third and fourth walls which is opposite said wall containing said aperture.

7. The combination as set forth in claim 1 wherein said rectangular waveguide includes said third and fourth walls which are relatively closer together than are said first and second walls and wherein one of said third and fourth walls includes said optically transmissive aperture.

8. In combination:

a rectangular waveguide comprising opposed first and second walls and opposed third and fourth walls each adjacent said first and second walls, said first, second, third and fourth walls defining an opening in said waveguide, any one of said first, second, third and fourth walls including an optically transmissive aperture, said waveguide having associated propagation characteristics;

a switchable optical illumination source comprising a laser diode array positioned in said aperture for illuminating a portion of said opening, said source being switchable between an illuminating state and a non-illuminating state;

means coupled to said source for alternately switching said source between said illuminating state and said non-illuminating state; and a semiconductor slab positioned in said opening having a surface capable of being illuminated by said source, said surface characterized by predetermined dimensions;

said slab, when illuminated by said source in its illuminating state, inducing plasma for altering said propagation characteristics associated with said waveguide.

9. The combination as set forth in claim 8 wherein said laser diode array is of dimensions as measured in a plane passing along said wall containing said aperture which are substantially the same as said dimensions of said surface of said semiconductor slab.

10. The combination as set forth in claim 8 wherein said semiconductor slab is positioned in said opening at another wall of said first, second, third and fourth walls which is opposite said wall containing said aperture.

11. The combination as set forth in claim 10 wherein said rectangular waveguide includes said third and fourth walls which are relatively closer together than are said first and second walls and wherein one of said first and second walls includes said optically transmissive aperture.

12. The combination as set forth in claim 10 wherein said rectangular waveguide includes said third and fourth walls which are relatively closer together than are said first and second walls and wherein one of said third and fourth walls includes said optically transmissive aperture.

13. The combination as set forth in claim 8 wherein said rectangular waveguide includes said third and fourth walls which are relatively closer together than are said first and second walls and wherein one of said third and fourth walls includes said optically transmissive aperture.

14. The combination as set forth in claim 8 wherein said rectangular waveguide includes said third and fourth walls which are relatively closer together than are said first and second walls and wherein one of said first and second walls includes said optically transmissive aperture.

* * * * *